US008107665B2

(12) United States Patent
Haapapuro et al.

(10) Patent No.: US 8,107,665 B2
(45) Date of Patent: Jan. 31, 2012

(54) INSERT EARPHONE USING A MOVING COIL DRIVER

(75) Inventors: Andrew J. Haapapuro, Arlington Heights, IL (US); Viorel Drambarean, Skokie, IL (US); Mead C. Killion, Elk Grove Village, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 1352 days.

(21) Appl. No.: 11/699,910

(22) Filed: Jan. 30, 2007

(65) Prior Publication Data

US 2007/0189569 A1 Aug. 16, 2007

Related U.S. Application Data

(60) Provisional application No. 60/763,264, filed on Jan. 30, 2006, provisional application No. 60/803,440, filed on May 30, 2006.

(51) Int. Cl.
*H04R 25/00* (2006.01)

(52) U.S. Cl. ..... 381/380; 381/370; 381/382

(58) Field of Classification Search ..... 381/322, 381/325, 327–328, 380–381; 379/430, 443–444
See application file for complete search history.

(56) References Cited

U.S. PATENT DOCUMENTS 2,521,414 A * 9/1950 Schier ..... 381/328
3,995,113 A 11/1976 Tani

FOREIGN PATENT DOCUMENTS

EP 08225796 2/1998

OTHER PUBLICATIONS

Chinese Office Action dated Aug. 30, 2011 in Application 200780003899.0 (15 pages including English translation).

* cited by examiner

*Primary Examiner* — Suhan N

(74) *Attorney, Agent, or Firm* — McAndrews, Held & Malloy, Ltd.

(57) ABSTRACT

Certain embodiments of the invention may be found in an insert earphone assembly. The insert earphone assembly may comprise a housing and a transducer located in the housing. The transducer may be for converting electrical signals received into sound energy. The insert earphone apparatus may further comprise an insert element. The insert element may be at, least partially integrated within the housing. The insert element may also comprise a main sound channel for communicating the sound energy from the transducer to a user. In certain embodiments, one or more of the body and the insert element may comprise one or more auxiliary ducts and one or more auxiliary volume spaces. The one or more auxiliary ducts and one or more auxiliary volume spaces may be separated by one or more auxiliary dampers. In certain embodiments, a diameter, length and/or shape of the one or more auxiliary ducts or one or more auxiliary volume spaces may be adjusted so as to modify an insertion response characteristic of the insert earphone assembly.

17 Claims, 20 Drawing Sheets

Killion, Berger, Nuss Average Ear Response

INSERT EARPHONE USING A MOVING COIL DRIVER

CROSS-REFERENCE TO RELATED APPLICATIONS/INCORPORATION BY REFERENCE

The present application claims priority under 35 U.S.C. §119(e) to provisional application Ser. No. 60/763,264, filed on Jan. 30, 2006, the entire contents of which are hereby expressly incorporated herein by reference. The present application claims priority under 35 U.S.C. §119(e) to provisional application Ser. No. 60/803,440, filed on May 30, 2006, the entire contents of which are hereby expressly incorporated herein by reference.

FIELD OF THE INVENTION

Certain embodiments of the invention relate to sound processing devices. More specifically, certain embodiments of the invention relate to a method and system for insert earphone using a moving coil driver.

BACKGROUND OF THE INVENTION

Use of insert earphones has risen considerably with the success of products like the Apple iPod. For the most part, the consumer's purchasing decision may be motivated by price-point more than by sound quality. The electro-acoustic transduction element traditionally used to create high-fidelity insert earphones is the device based upon the balanced-armature design. The complexity and subsequent high-manufacturing cost of this component is responsible for the high price-point of high-fidelity insert earphones.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

An insert earphone assembly, substantially as shown in and/or described in connection with at least one of the figures, as set forth more completely in the claims.

Various advantages, aspects and novel features of the present invention, as well as details of an illustrated embodiment thereof, will be more fully understood from the following description and drawings.

DETAILED DESCRIPTION OF THE INVENTION

Certain embodiments of the invention may be found in a method and system for insert earphone using a moving coil driver. Driver designs based on the moving-coil structure are significantly less complicated and, therefore, less expensive. In accordance with an embodiment of the invention, an insert earphone may use a moving-coil driver to realize an insert earphone device with optimal sound quality and high isolation of external noise at a very affordable price-point.

Figure 1:
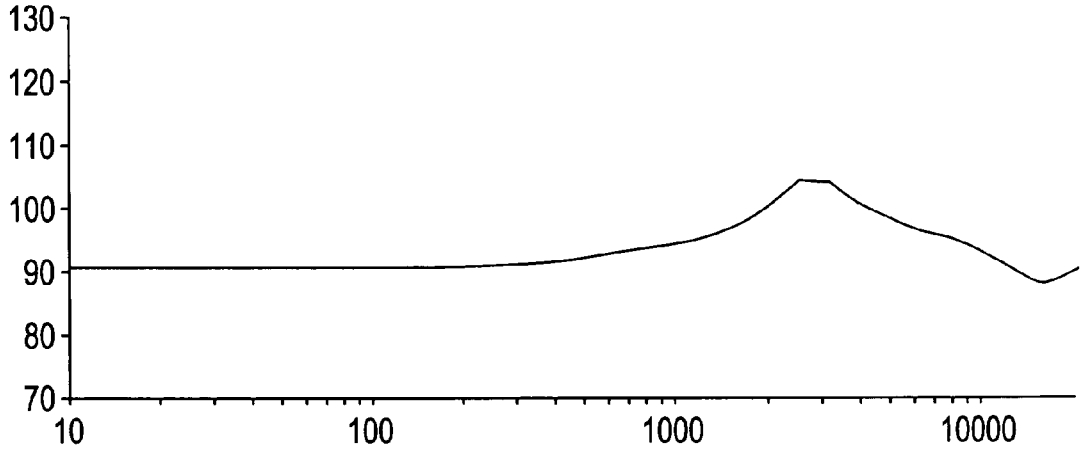
FIG. 1 is an exemplary graph for estimating the average human ear response, which may be used in accordance with an embodiment of the invention.

FIG. 1 is an exemplary graph for estimating the average human ear response, which may be used in accordance with an embodiment of the invention.

Mead Killion, Elliott Berger and Robert Nuss have developed a composite curve to estimate the average human ear response, as illustrated in FIG. 1.

Accuracy Score Defined. Accuracy score may be defined as a 25-band extension of a response accuracy rating system based upon the 1979 Consumers Union procedure applied to loudspeaker assessment. It employs Stevens Mark VI loudness values to weight the importance of defects or "compromises" in the frequency response. The Accuracy Score has been shown to correlate strongly to subjective (e.g. jury) assessments of signal (e.g. music) fidelity.

In accordance with an embodiment of the invention, an insert earphone using a moving coil driver may be adapted to achieve a highest Accuracy Score of any moving coil design of 80% or higher. The highest accuracy score of moving coil designs in industry has been less than 70% accurate. This applies to either concha mounted "earbuds" or partial/canal sealing models.

Figure 2:
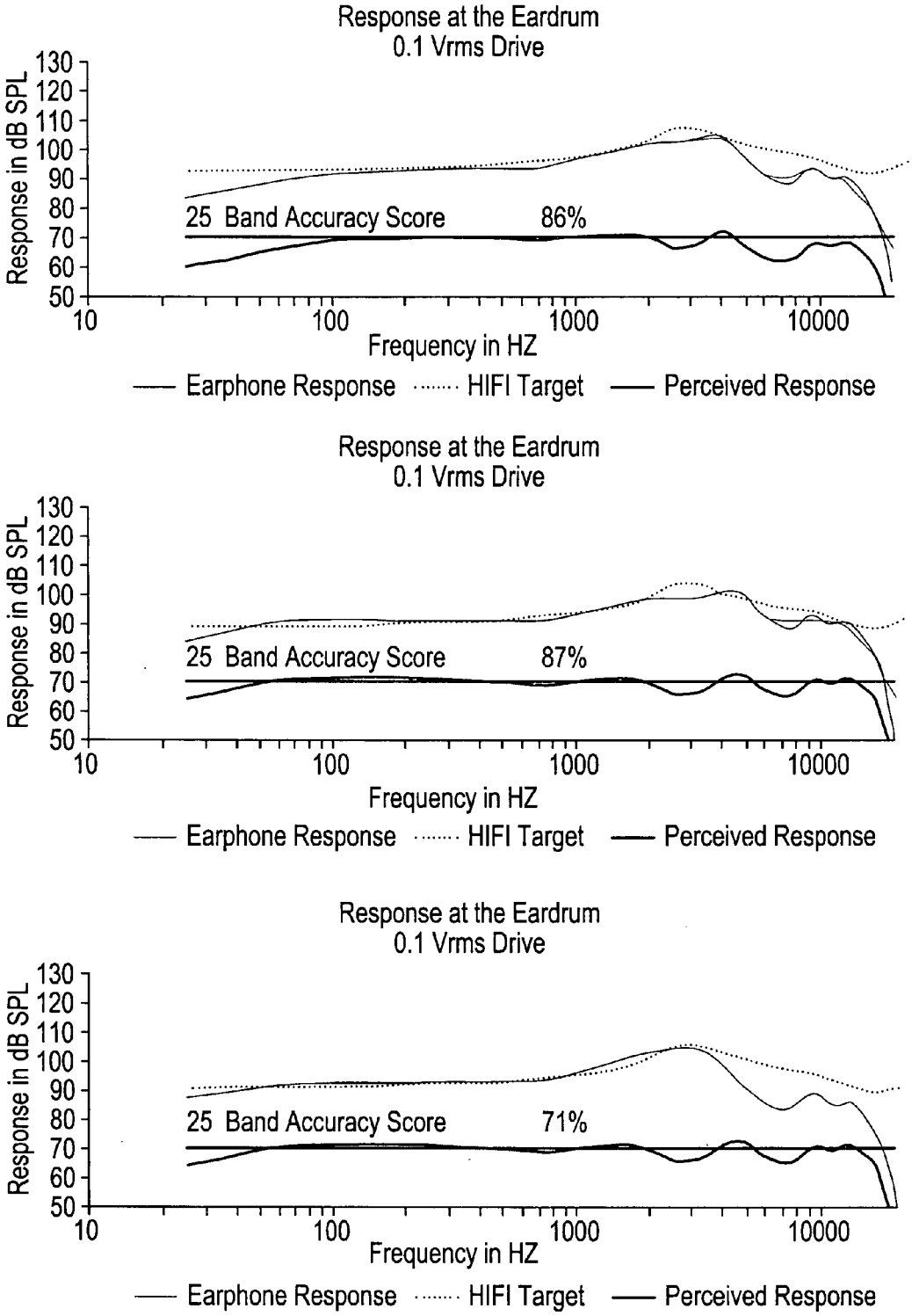
FIG. 2 illustrates exemplary graphs of responses at the eardrum of moving coil designs using methods described herein to achieve high accuracy frequency responses.

FIG. 2 illustrates exemplary graphs of responses at the eardrum of moving coil designs using methods described herein to achieve high accuracy frequency responses.

Figure 3:
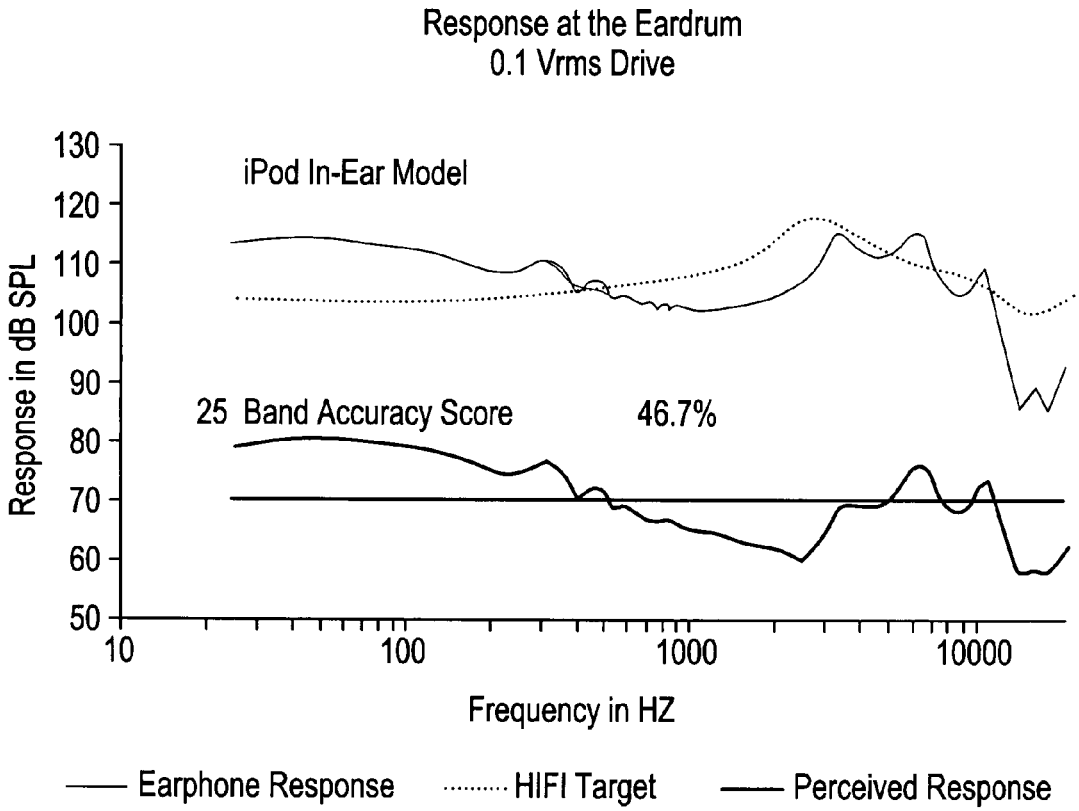
FIG. 3 illustrates an exemplary graph of responses at the eardrum of concha mounted or partially/full sealing units currently on the market compared to the average human ear response as seen in FIG. 1.

FIG. 3 illustrates an exemplary graph of a response at the eardrum of a concha mounted or partially/full sealing unit currently on the market compared to the average human ear response as seen in FIG. 1.

Figure 4:
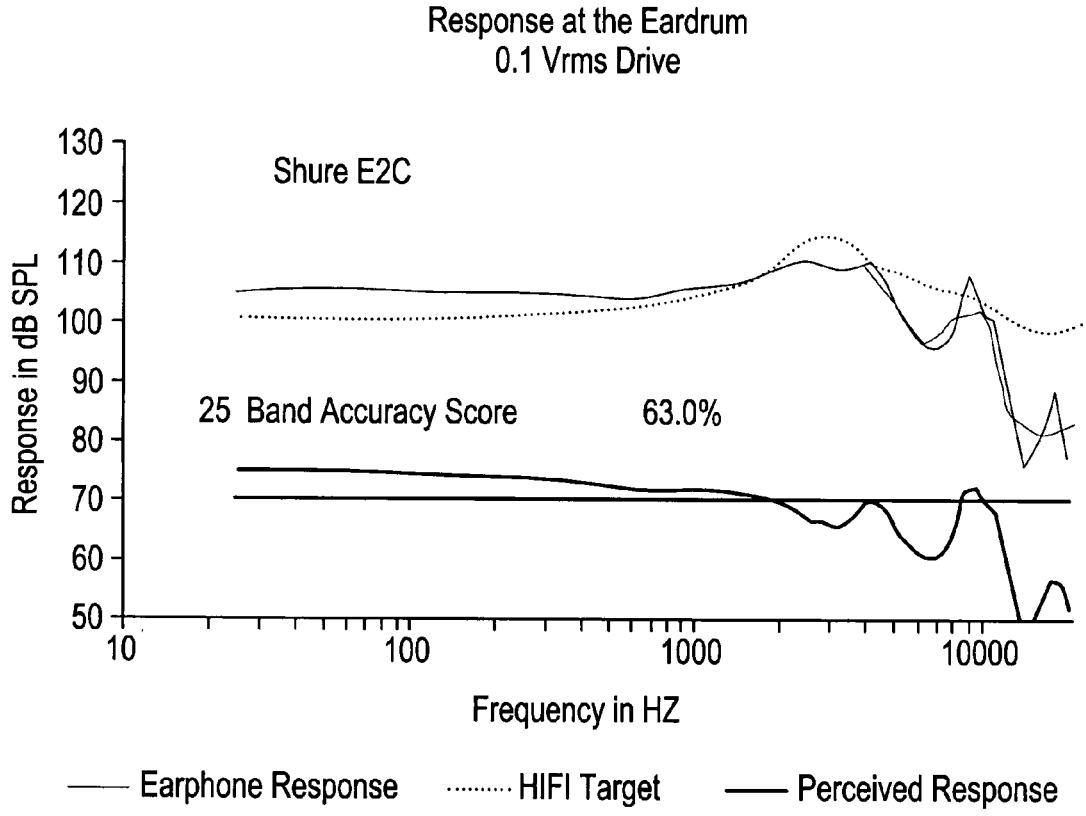
FIG. 4 illustrates an exemplary graph of responses at the eardrum of concha mounted or partially/full sealing units currently on the market compared to the average human ear response as seen in FIG. 1.

FIG. 4 illustrates an exemplary graph of a response at the eardrum of a concha mounted or partially/full sealing unit currently on the market compared to the average human ear response as seen in FIG. 1. FIGS. 3 and 4 demonstrate the current state-of-the-art for earphone products that employ moving coil drivers.

In accordance with an embodiment of the invention, methods of modifying insertion responses while obtaining external noise reduction may include, for example, the use of damping elements, auxiliary volumes, sound channels, and/or electronic components.

Figure 5A:
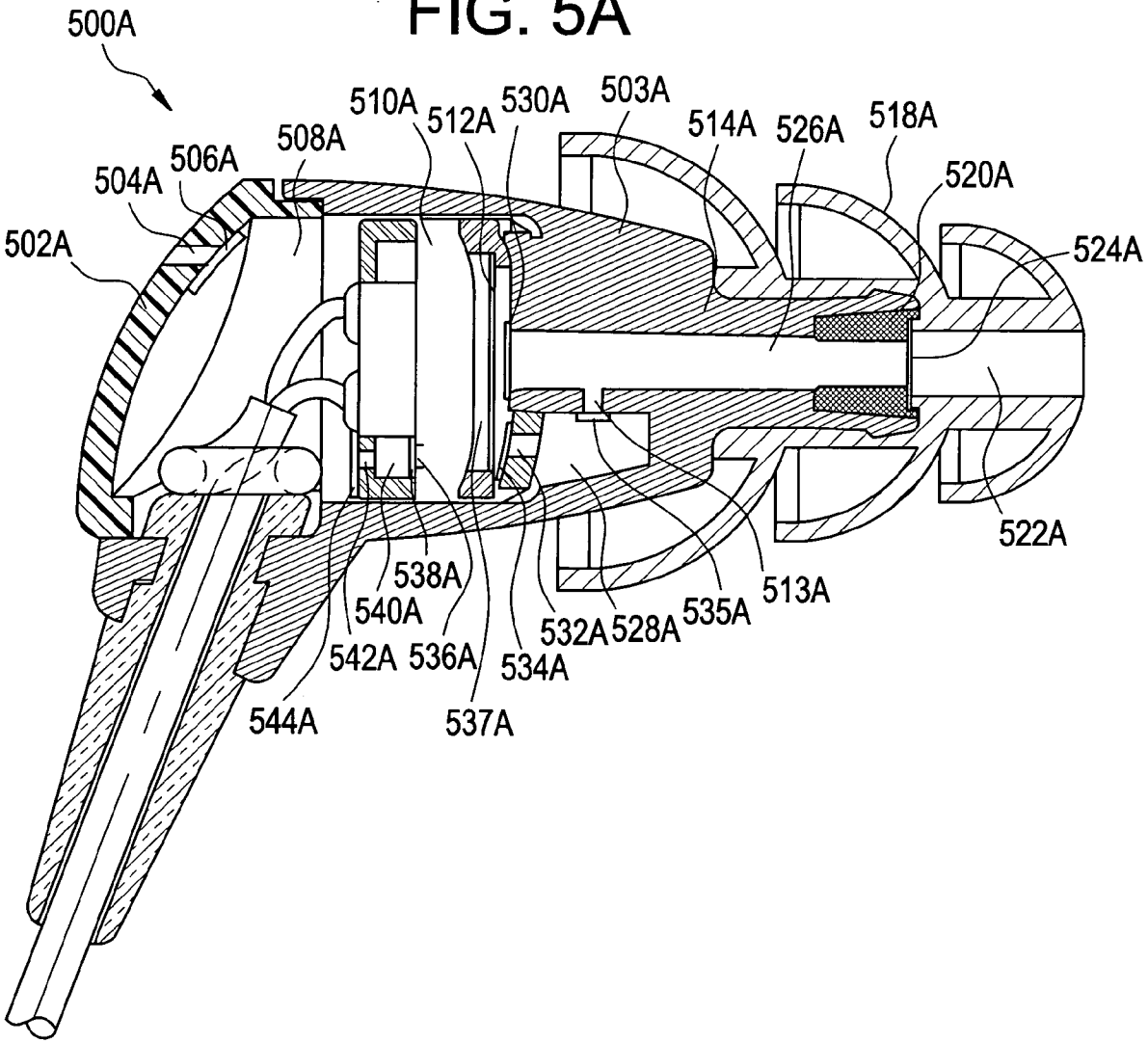
FIG. 5A is a diagram illustrating exemplary acoustic construction of a high accuracy moving coil design for an insert earphone assembly with a complete form factor designed to fit deeply into the ear canal of a user, in accordance with an embodiment of the invention.

FIG. 5A is a diagram illustrating exemplary acoustic construction of a high accuracy moving coil design for an insert earphone assembly with a complete form factor designed to fit deeply into the ear canal of a user, in accordance with an embodiment of the invention. Referring to FIG. 5A, the insert earphone 500A may comprise a cap 502A, a body 503A, a moving coil driver 510A, a diaphragm 512A, an insert element 514A, a plug 520A, and an eartip 518A. In addition, the insert earphone 500A may comprise damping elements 506A, 524A, 530A, 534A, 535A, 538A, and 544A which may be used with sound channels 504A, 522A, 526A, 532A, 513A, 536A, and 542A, respectively. The damping elements 506A, 524A, 530A, 534A, 535A, 538A, and 544A may also be used in connection with auxiliary volumes 508A, 528A, 537A, and 540A, as well as with diaphragm 512A. These acoustic combinations may also be aided by use of electronic components, such as the electronic filter illustrated in FIG. 5C and/or the electronic filter/bypass circuit illustrated in FIG. 5D.

The insert earphone 500A, whose natural resonance may be at 4 kHz, may be tuned by these means so that a resonant peak may occur at or around 2.7 kHz, for example, which may be approximately 12 dB higher in level than measured at 500 Hz. The frequency response may then roll off at approximately 3 dB/octave. The insert earphone 500A may be adapted for deep insertion in the ear canal of a user to achieve high levels of external noise reduction. Deep insertion of the earphone 500A may be enabled by a slender form factor so that 20 dB or more of external noise isolation may be achieved by the earphone 500A.

Depending on the natural acoustic behavior of a the moving coil design of the insert earphone 500A, the combination of response shaping, resonant peak shifting and/or smoothing may require any combination of damping values, sound channels, auxiliary volumes, auxiliary compliances and/or electronic filtering to shape the frequency response of the earphone 500A. In this regard, the frequency response of the insert earphone 500A may be varied by utilizing a different number of damping elements, sound channels, auxiliary ducts, resonant ducts, and/or auxiliary volumes. Furthermore, frequency response of the insert earphone 500A may be varied by using one or more additional electronic components within the insert earphone, such as, for example, the components disclosed herein below with regard to FIGS. 5C and 5D.

In one embodiment of the invention, there may be two natural peaks close to the target peak frequency. In such instances, damping elements 524A and/or 530A may be used to reduce both peaks to a desired shape. If the peak closest to the target "damps out" before another un-desired peak, a change in one or more insert earphone components may be necessary. If an undesired peak is moved from 4 kHz down to 3 kHz, for example, the diameter of the front sound channel 522A and/or the diameter of the sound channel 526A may be reduced. In this regard, damping elements 524A and/or 530A may be used to smooth out the frequency response of the insert earphone 500A.

In another embodiment of the invention, the damping element 524A may be mounted to a removable plug 520A as a means of replacement in instances when the damping element 524A becomes clogged with earwax or other contaminants. Damping element 530A may also be attached to the insert element 514A.

In yet another embodiment of the invention, low-frequency bass response of the insert earphone 500A may be increased by the use of a "modified Thuras tube" with regard to the sealed back auxiliary volume 540A. In this regard, the size of the bass boost may be determined, for example, by the relative values of the diaphragm compliance and the volume of the auxiliary back volume 540A. The frequency at which the bass boost begins may be determined by the resistance and inertance, or acoustic mass, of the connecting tube 542A and/or 536A, or the resistance of the damper 538A and/or 544A. The rate of rise of the low-frequency bass response may increase with the use of inertance. Such "modified Thuras tube" method of using a filter/bypass circuit within the insert earphone 500A may be used to increase the low frequency sensitivity without changing the high-frequency sensitivity. In this regard, the insert earphone 500A may be used as a means of bass compensation for devices such as MP3 players, for example, with output impedance that may be higher for low frequencies, thereby delivering less bass energy to the earphone as compared to devices with constant output impedance through the audio frequency band.

Figure 5B:
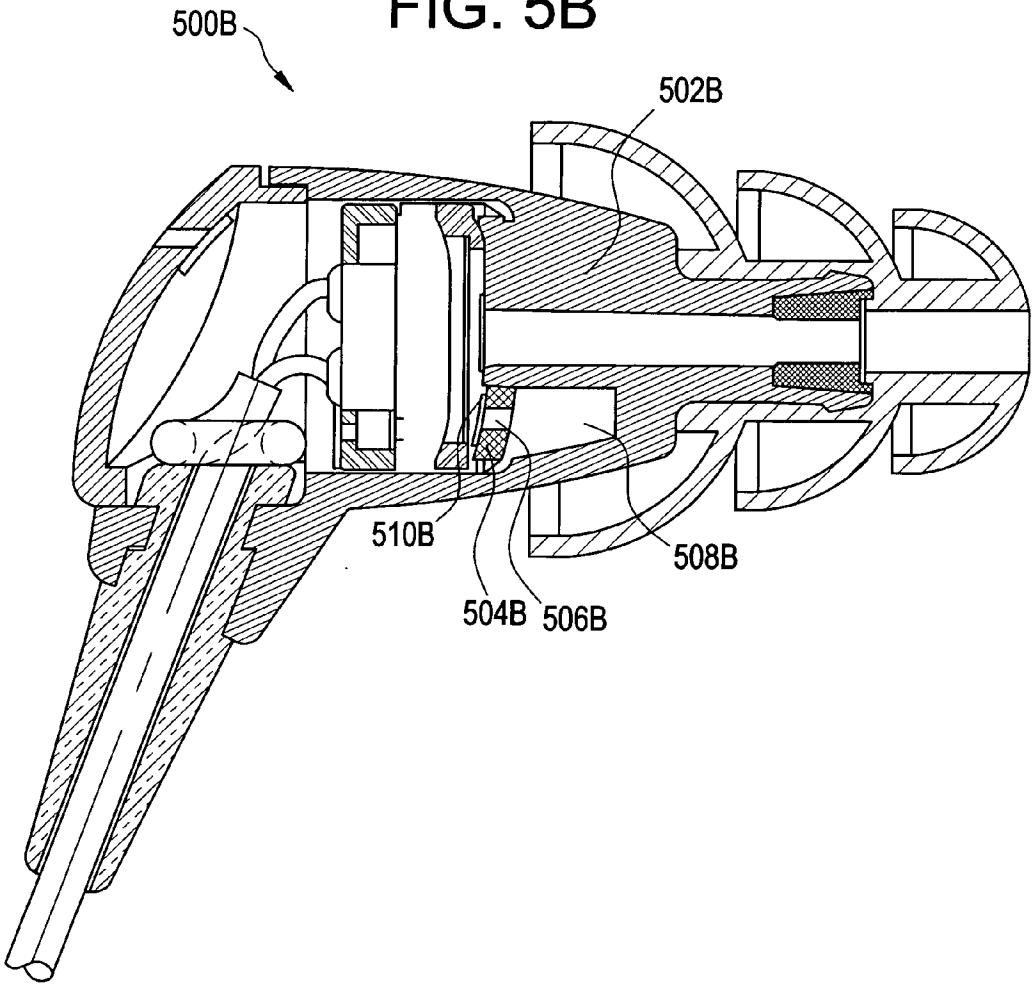
FIG. 5B is a diagram illustrating exemplary acoustic construction of a high accuracy moving coil design for an insert earphone assembly with a complete form factor designed to fit deeply into the ear canal of a user, in accordance with an embodiment of the invention.

FIG. 5B is a diagram illustrating exemplary acoustic construction of a high accuracy moving coil design for an insert earphone assembly with a complete form factor designed to fit deeply into the ear canal of a user, in accordance with an embodiment of the invention. Referring to FIG. 5B, the insert earphone 500B is similar to the insert earphone 500A of FIG. 5A. However, the insert earphone 500B comprises an integral body 502B. In this regard, the insert element 514A of insert earphone 500A may be integrated with the body 503A. Auxiliary volume 508B and auxiliary damping element 510B of insert earphone 500B may correspond to auxiliary volume 528A and auxiliary damping element 534A, respectively, of insert earphone 500A. Additionally, the auxiliary duct 506B may be disposed within a removable plug 504B, thereby making optional the use of the auxiliary duct 506B and the auxiliary volume 508B.

Figure 5C:
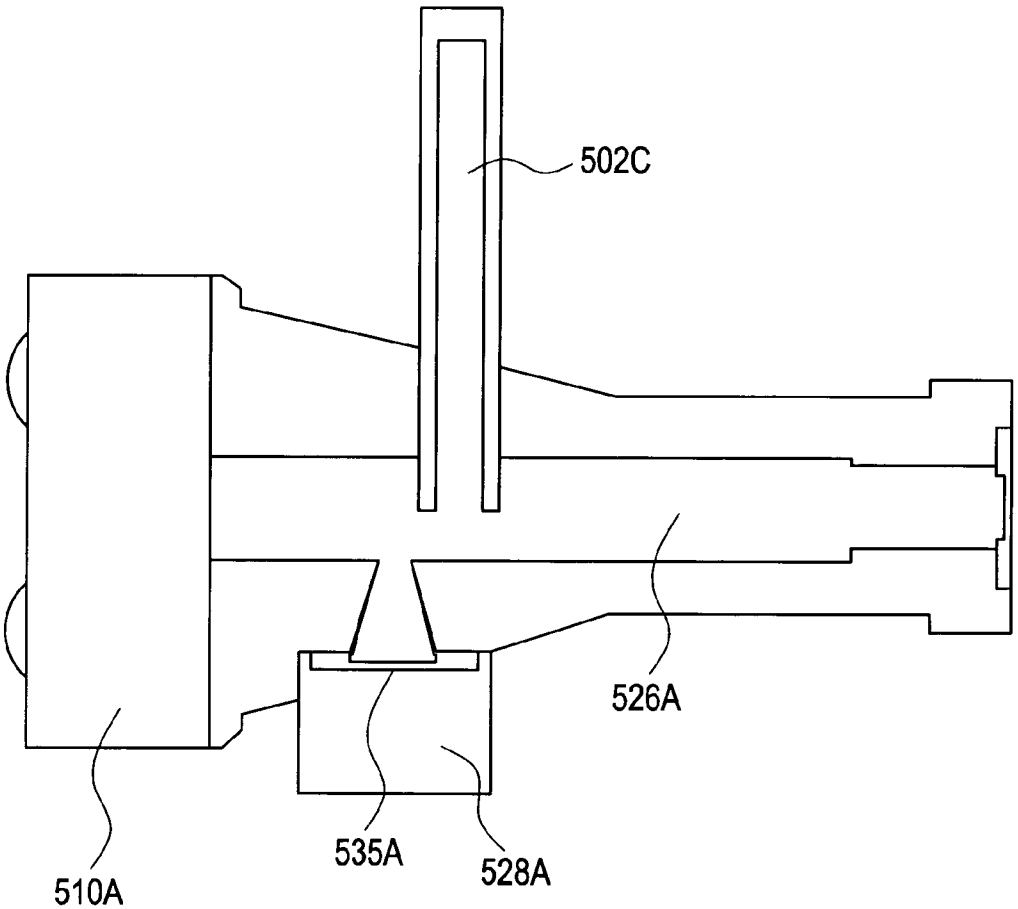
FIG. 5C is a diagram illustrating a portion of an insert earphone assembly using one or more acoustic resonant ducts, in accordance with an embodiment of the invention.

FIG. 5C is a diagram illustrating an insert earphone assembly using one or more acoustic resonant ducts, in accordance with an embodiment of the invention. Referring to FIGS. 5A and 5C, in one embodiment of the invention, a resonant duct 502C may be utilized by the insert earphone 500A. In this regard, by utilizing the resonant duct 502C, a deficiency in the response may be increased and excess energy in another frequency band may be simultaneously reduced. Therefore, by adding the resonant duct 502C to the main sound channel 526A, the frequency response of the insert earphone may be improved.

The resonant duct 502C may extend from the main sound channel 526A and may be tuned to have, for example, a ¼ wave anti-resonance at 10 kHz. In this regard, the acoustic tube and the resulting anti-resonance effect may be utilized to decrease and/or prevent excess energy which may be present within the insert earphone 500A. Furthermore, by utilizing the resonant duct 502C in connection with the side cavity 528A and the auxiliary damper 535A may result in reduction of excessive energy at 10 kHz, as well as an increase of a deficiency in the frequency response from 4 kHz to 8 kHz. Consequently, the use of the resonant duct 502C within the insert earphone 500A may result in a smoother and accurate frequency response.

Figure 5D:
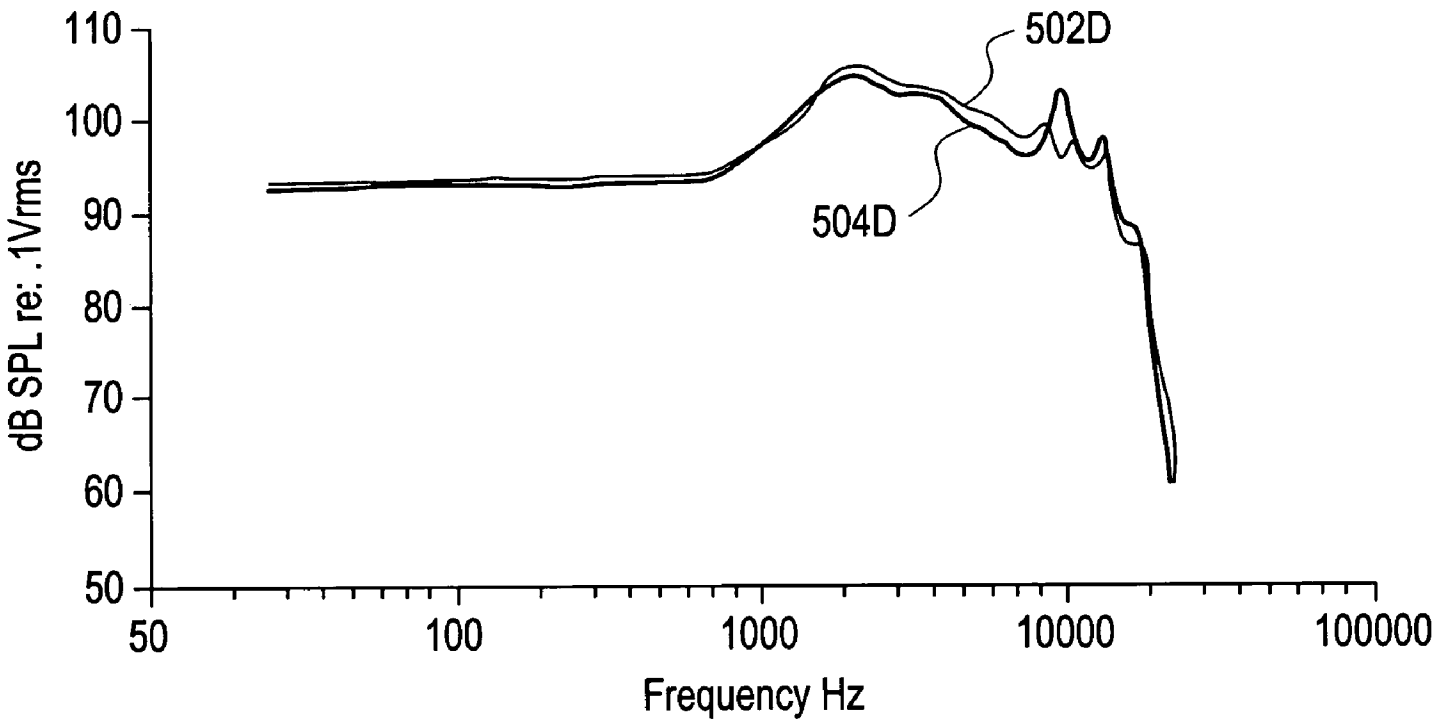
FIG. 5D illustrates exemplary graphs of frequency responses of an insert earphone assembly using one or more resonant ducts, in accordance with an embodiment of the invention.

FIG. 5D illustrates exemplary graphs of frequency responses of an insert earphone assembly using one or more resonant ducts, in accordance with an embodiment of the invention. Referring to FIG. 5D, graph 504D may represent exemplary frequency response of the insert earphone 500A using side cavity 528A with the auxiliary damper 535A and without additional acoustic volume, such as resonant duct 502C. Graph 502D may represent exemplary frequency response of the insert earphone 500A using side cavity 528A, auxiliary damper 535A and the additional resonant duct 502C for achieving an anti-resonance effect. In this regard, it may be noted from graphs 502D and 504D that a smoother downward slope of the frequency response may begin at about 2 kHz up to about 16 kHz, for example.

Figure 5E:
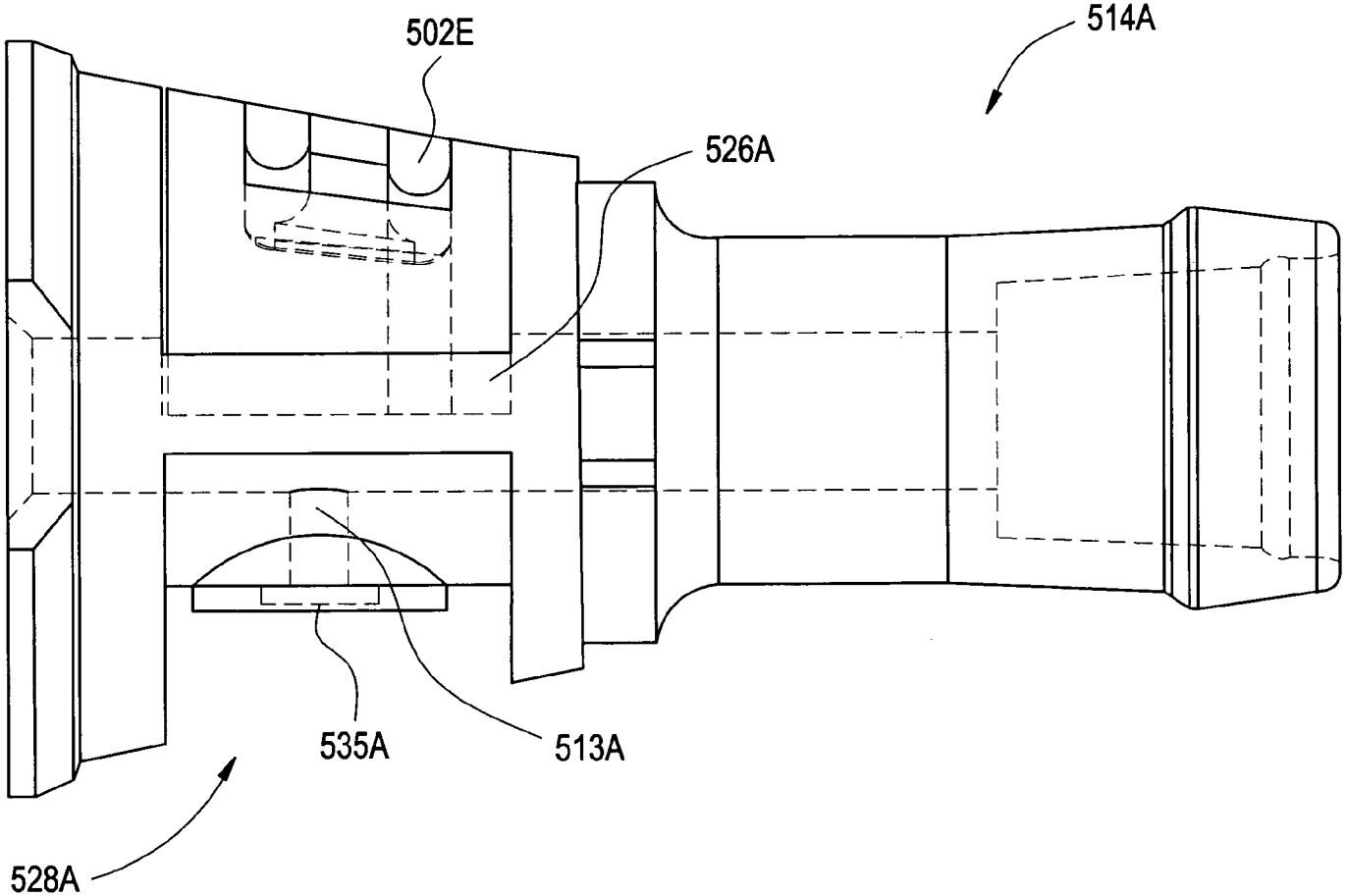
FIG. 5E is a diagram illustrating a portion of an insert earphone assembly using one or more resonant ducts, in accordance with an embodiment of the invention.

FIG. 5E is a diagram illustrating an insert earphone assembly using one or more resonant ducts, in accordance with an embodiment of the invention. Referring to FIG. 5E, there is illustrated the insert element 514A which is a part of the insert earphone assembly 500A of FIG. 5A. In one embodiment of the invention, the insert element 514A may comprise a resonant duct (RD) 502E. The RD 502E may comprise the resonant duct 502C of FIG. 5C, and may comprise one or more interconnected volume portions of varying lengths. Furthermore, the RD 502E may extend from the main sound channel 526A and may be tuned to have, for example, a ¼ wave anti-resonance at about 10 kHz, as explained herein above with regard to the resonant duct 502C.

Figure 5F:
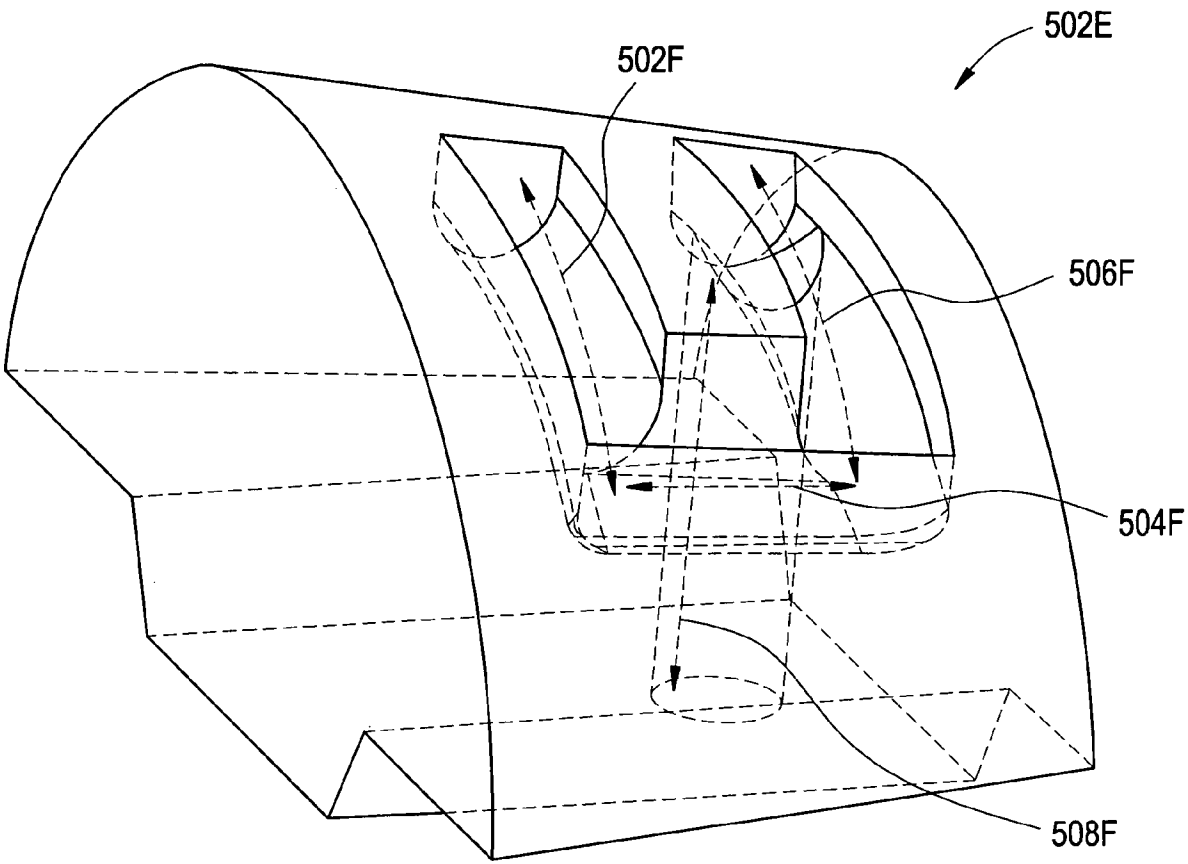
FIG. 5F is a diagram illustrating a portion of an insert earphone assembly using one or more resonant ducts, in accordance with an embodiment of the invention.

FIG. 5F is a diagram illustrating a portion of an insert earphone assembly using one or more resonant ducts, in accordance with an embodiment of the invention. Referring to FIG. 5F, there is illustrated a diagram of the RD 502E. In one embodiment of the invention, the RD 502E may comprise four interconnected volume portions 502F, . . . , 508F. Each of the interconnecting volume portions 502F, . . . , 508F may be of varying length, diameter and/or shape. In addition, the volume portions pairs 508F-506F, 506F-504F, and 504F-502F may be connected at varying angles, resulting in the RD 502E.

Figure 5G:
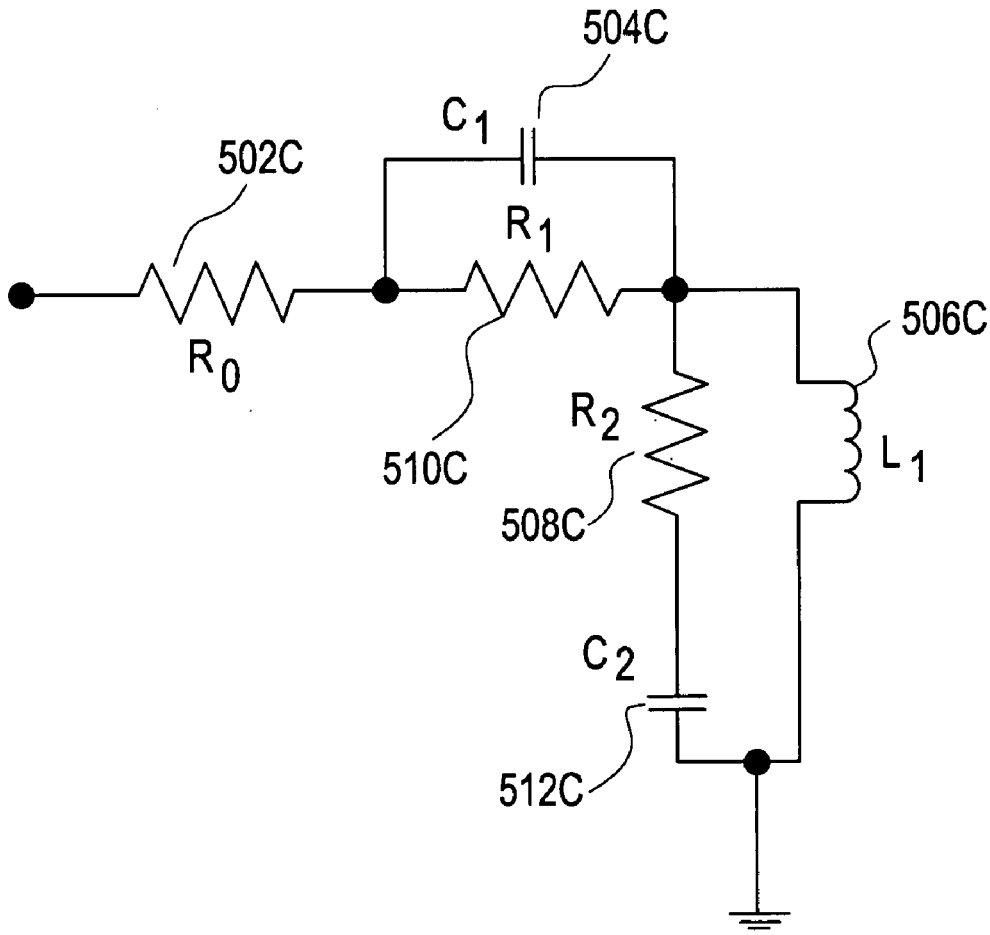
FIG. 5G is a schematic diagram of an exemplary passive electrical filter, which may be utilized in connection with an embodiment of the present invention.

FIG. 5G is a schematic diagram of an exemplary passive electrical filter, which may be utilized in connection with an embodiment of the present invention. Referring to FIG. 5G, the passive electrical filter may comprise resistors 502*c*, 508*c*, and 510*c*, capacitors 504*c* and 512*c*. Inductor 506*c* may be functionally equivalent and may indicate a moving coil driver. The passive electrical filter may be used in connection with an insert earphone, such as the insert earphone 500A of FIG. 5A, to vary the frequency response of the insert earphone. In one embodiment of the invention, the electrical filter may be implemented within the insert earphone 500A and filtering may be triggered automatically or upon an input from a user of the insert earphone 500A. Even though one implementation of a passive electrical filter is disclosed in FIG. 5G, the present invention may not be so limited and other filter implementations may also be used in connection with an insert earphone such as the insert earphone 500A in FIG. 5A.

Figure 5H:
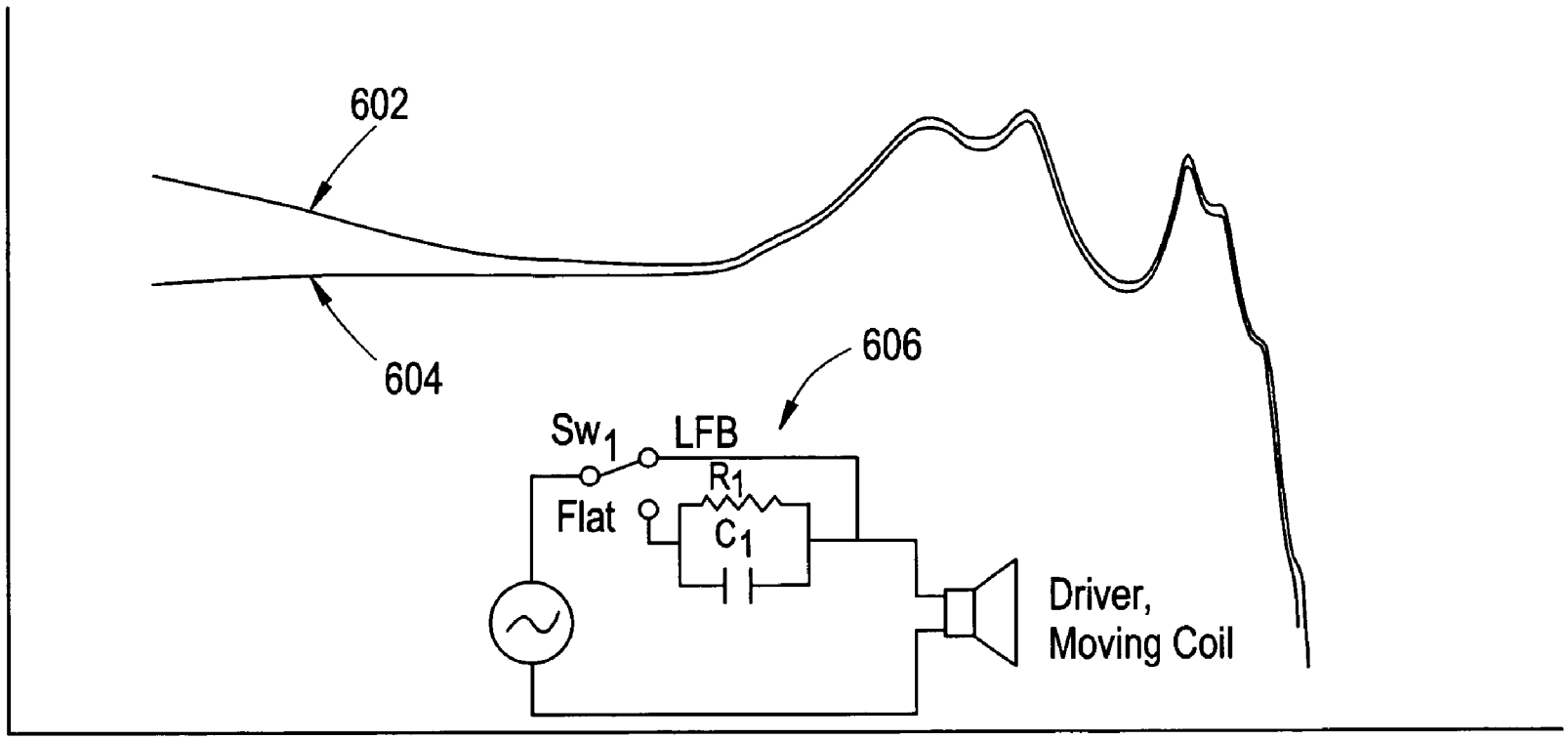
FIG. 5H is a schematic diagram of an exemplary electrical filter/bypass circuit for modifying bass response, which may be used in accordance with an embodiment of the invention.

FIG. 5H is a schematic diagram of an exemplary electrical filter/bypass circuit 606 for modifying bass response, which may be used in accordance with an embodiment of the invention. Referring to FIG. 5H, the filter circuit 606 may comprise a resistor R1, a capacitor C1 and a switch SW1. In one embodiment of the invention, the filter circuit 606 may comprise a high-pass filter. Furthermore, the filter circuit 606 may be coupled to a moving coil driver, such as the moving coil driver 510A in FIG. 5A. The electrical filter circuit 606 may be used within an insert earphone, such as the insert earphone 500A in FIG. 5A, to select between a flat bass response, represented by graph 604, and a boosted bass response, represented by graph 602.

A boosted bass response 602 may be obtained when the R1-C1 filter circuit is bypassed when the switch SW1 is switched to the Low Frequency Boost (LFB) position. The flat bass response 604 may be obtained within the insert earphone 500A when the switch SW1 is switched to the "flat" position. Resistance and capacitance R1 and C1 may be selected to correspond to the impedance of the moving coil driver 510A, for example.

In one embodiment of the invention, the electrical filter/bypass circuit 606 may be implemented within the insert earphone 500A and filtering may be triggered automatically or upon an input from a user of the insert earphone 500A and a corresponding change in the position of switch SW1. Even though one implementation of the electrical filter circuit 606 is disclosed in FIG. 5H, the present invention may not be so limited and other filter implementations may also be used in connection with an insert earphone such as the insert earphone 500A in FIG. 5A. By using the electrical filter/bypass circuit 606 within the insert earphone 500A, a bass boost may be provided with fixed high-frequency gain without using a shunt capacitor. Bass boost may be achieved by, for example, utilizing a "modified Thuras tube" method, as described herein.

Figure 5I:
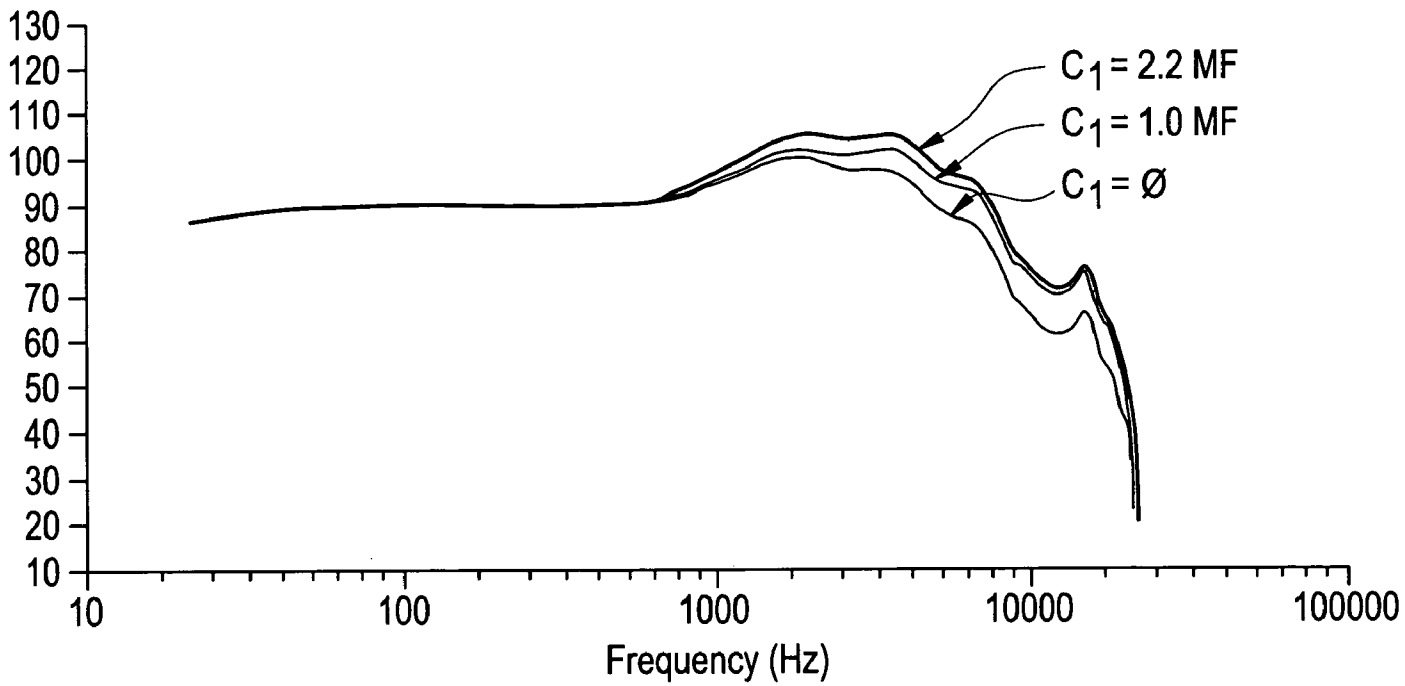
FIG. 5I is a graph illustrating the effect of an exemplary high pass filter for shaping the response of an insert earphone, in accordance with an embodiment of the invention.

FIG. 5I is a graph illustrating the effect of an exemplary high pass filter for shaping the response of an insert earphone, in accordance with an embodiment of the invention. Referring to FIGS. 5G and 5I, the graph of FIG. 5I demonstrates the effect of a high pass filter where a source may be connected through a resistor 510*c* parallel with a capacitor 504*c*, in series with a driver 506*c* to ground. The value of the resistance 510*c* may determine the sensitivity of the insert earphone 500A for low frequencies. The low frequency impedance, Xc, of capacitor 504*c* may be high and thus resistor 510*c* may dominate and the current flow may remain low to the driver. At high frequencies, however, Xc of capacitor 504*c* may become low and may pass more current to the driver 506*c*, thereby resulting in higher output.

Figure 5J:
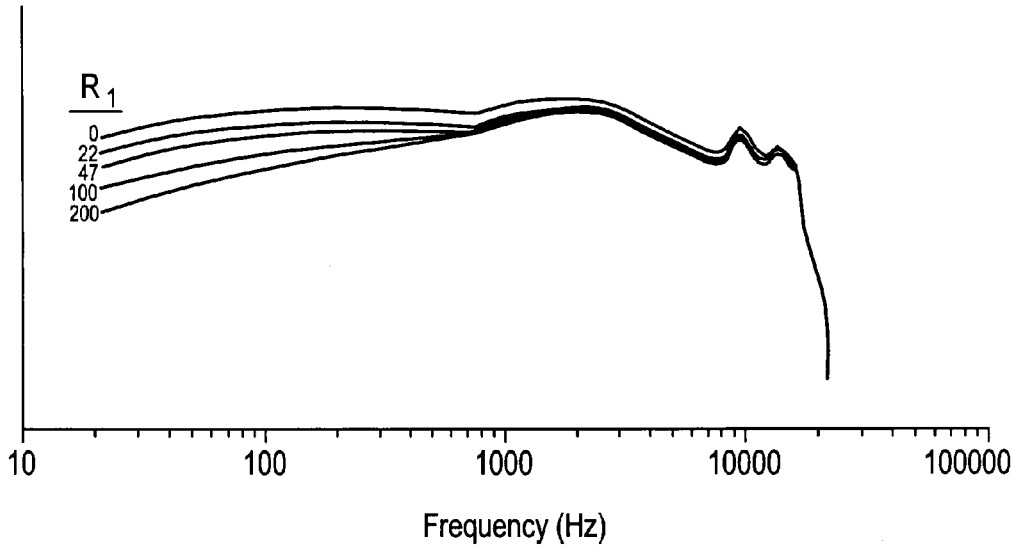
FIG. 5J is a graph illustrating the effect of an exemplary high pass filter for shaping the response of an insert earphone, in accordance with an embodiment of the invention.

FIG. 5J is a graph illustrating the effect of an exemplary high pass filter for shaping the response of an insert earphone, in accordance with an embodiment of the invention. Referring to FIGS. 5G and 5J, the graph of FIG. 5J illustrates another example of a high pass filter where capacitor 504*c* may remain and resistance 510*c* may be varied. In this regard, the low-pass filter in FIG. 5G may be tuned to apply a first order high frequency response roll-off where desired.

Figure 6:
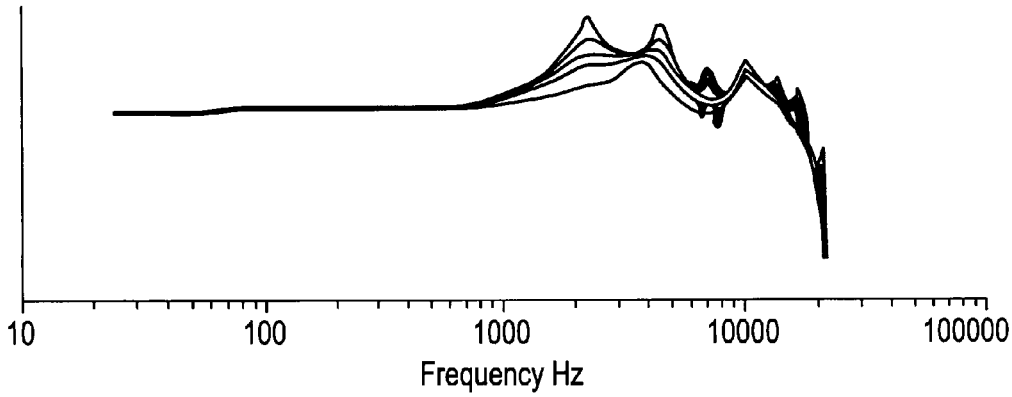
FIG. 6 is a graph that illustrates an exemplary response of an insert earphone with various levels of acoustic damping, in accordance with an embodiment of the invention.

FIG. 6 is a graph that illustrates an exemplary response of an insert earphone with various levels of damping, in accordance with an embodiment of the invention.

Depending on the natural behavior of a given moving coil design, the combination of resonant peak shifting and/or smoothing may require any range of damping values. If, for example, there are two natural peaks close to the target peak frequency, damping may be used to reduce both peaks to the correct shape. However, if the peak closest to the target happens to "damp out" before another un-desired peak, a change in front plumbing may be necessary. If an undesired peak is moved from 4 kHz, for example, down to 3 kHz, for example, a reduction in front plumbing diameter may be necessary. In this regard, peak movement and/or damping may smooth out the response.

Many moving coil drivers can produce extremely high sound pressure levels relative to their placement in the ear. In reference to the insert earphone 500A, a reduced amount of power may be required to develop acceptable level of sound pressure at the eardrum while maintaining desired sound quality. In one embodiment of the invention, the low frequency of a moving coil driver may be tuned by changing internal capacitance or rear volume (540A and/or 508A). The size of the rear volume may depend on sensitivity and/or accuracy requirements. A smaller volume may reduce the low-mid frequency response sensitivity. However, the frequency response sensitivity of the earphone 500A may be regained by electro-acoustic transfer efficiency realized with sealed insert earphone designs of the earphone 500A.

Figure 7:
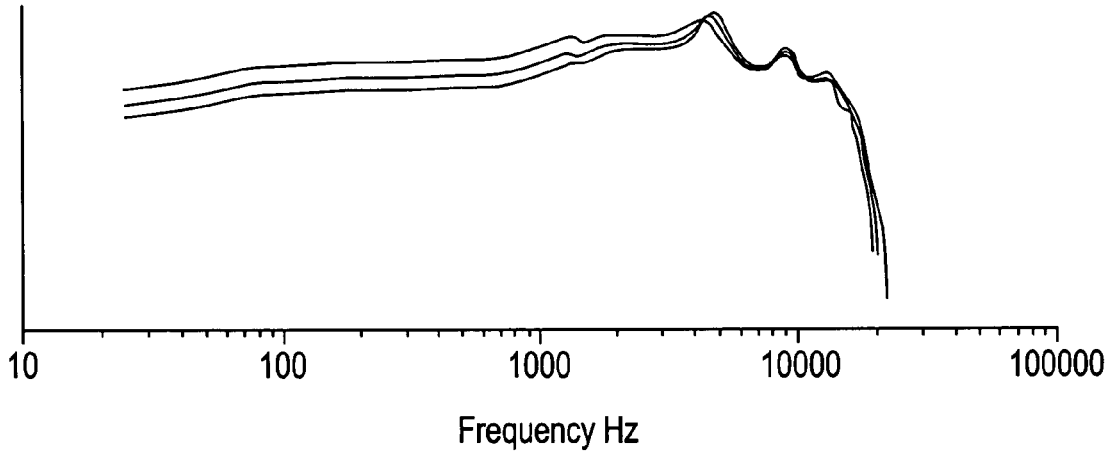
FIG. 7 is a graph that illustrates the effect on the frequency response when the sealed rear volume is varied, in accordance with an embodiment of the invention.

FIG. 7 is a graph that illustrates the effect on the frequency response when the sealed rear volume, such as the sealed rear volume 540A and/or 508A in FIG. 5A, is varied, in accordance with an embodiment of the invention. Referring to FIGS. 5A and 7, auxiliary volume 540A may be varied in connection with the auxiliary duct 542A, auxiliary damping element 544A, and auxiliary volume 508A.

In accordance with an embodiment of the invention, the speaker's internal capacitance may be reduced by encapsulating the volume of air around the back of the speaker similar to standard enclosed loudspeakers, which may be required for achieving external noise reduction. The size of this rear volume may depend on sensitivity and accuracy requirements. In this regard, FIG. 7 demonstrates the effect on the frequency response when the sealed rear volume(s) 540A, 508A are varied. In some instances, auxiliary volume 540A may be the only volume required in which case auxiliary duct 542A may be blocked and auxiliary damping element 544A may not be used.

In some instances, resonant peaks may be present, resulting in detraction from the listening experience. In one embodiment of the invention, the resonant peaks may be smoothed out by tuning of the front port 522A, 526A and/or by application of acoustic resistance 524A, 530A. In some instances it may be necessary to augment such remedial methods by incorporation of one or more series of inertance 532A resistance 534A tanks terminated by an acoustic capacitance 528A in the front acoustic path of the earphone 500A. Such structure may create a notch filter aimed at reducing the intensity of the undesired spectral energy.

Figure 8A:
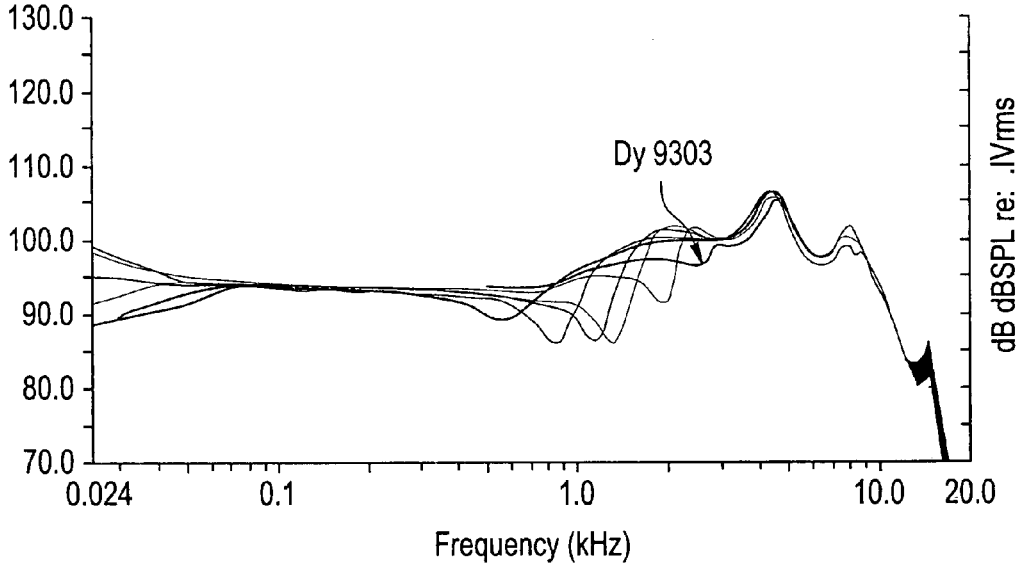
FIG. 8A is a graph that illustrates a varied acoustic notch filter and its effect on frequency response, in accordance with an embodiment of the invention.

FIG. 8A is a graph that illustrates a varied notch filter and its effect on frequency response, in accordance with an embodiment of the invention. An alternate path or additional path to auxiliary volume 528A from 532A, 534A is via auxiliary duct 513A and auxiliary damping element 535A. Referring to FIGS. 5A and 8A, a notch filter effect may be achieved with acoustic components in combination to reduce the level in a specific frequency band. For example, the main sound channel 526A and/or front speaker volume 535A may be varied. In addition, the auxiliary duct 513A and/or 532A leading to auxiliary volume 528A, may also be varied. Sound channel 526A and auxiliary duct 513A may comprise any geometric shape that results in the desired frequency response. The depth or "Q" of the notch filter may be limited by adding auxiliary damping elements 534A and/or 535A. Such notch filter combinations may be duplicated with different values and sizes to reduce energy in multiple spectral ranges.

Figure 8B:
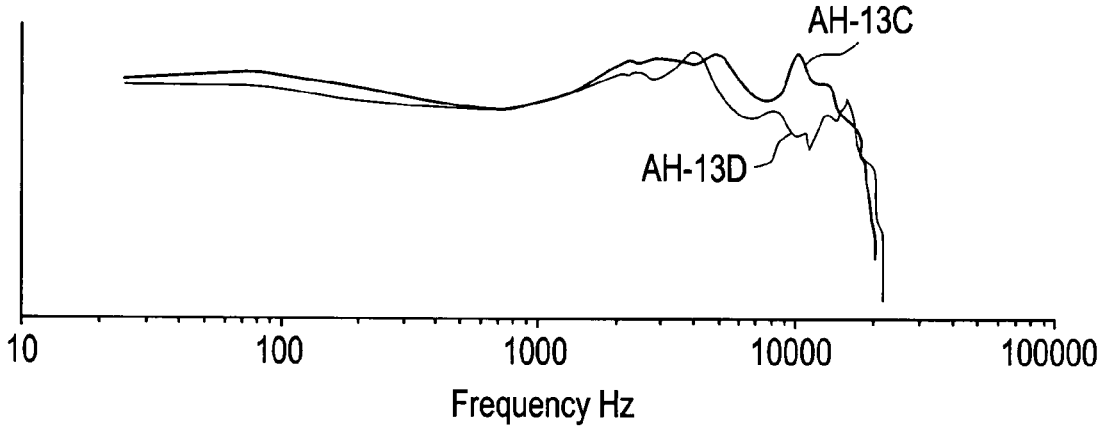
FIG. 8B is a graph that illustrates changes in frequency response of an insert earphone utilizing an auxiliary diaphragm, in accordance with an embodiment of the invention.

FIG. 8B is a graph that illustrates changes in frequency response of an insert earphone utilizing an auxiliary diaphragm, in accordance with an embodiment of the invention.

Undesired peaks in the response may also be reduced by use of one or more auxiliary diaphragms (512A). In order to realize cancellation, the diaphragm(s) must have characteristic impedances that are tuned to change phase relative to the driver diaphragm, within the frequency band of interest. The unchanged response (AH-13C) may be compared to a response incorporating an auxiliary diaphragm (AH-13D).

With one or more auxiliary diaphragms in place, an additional advantage may be realized within the insert earphone 500A. Resonant peaks may be directly shifted closer to a target range that may not have been otherwise attainable. Notch filters as described herein above may also be used to enhance the effect of auxiliary diaphragms.

Figure 9A:
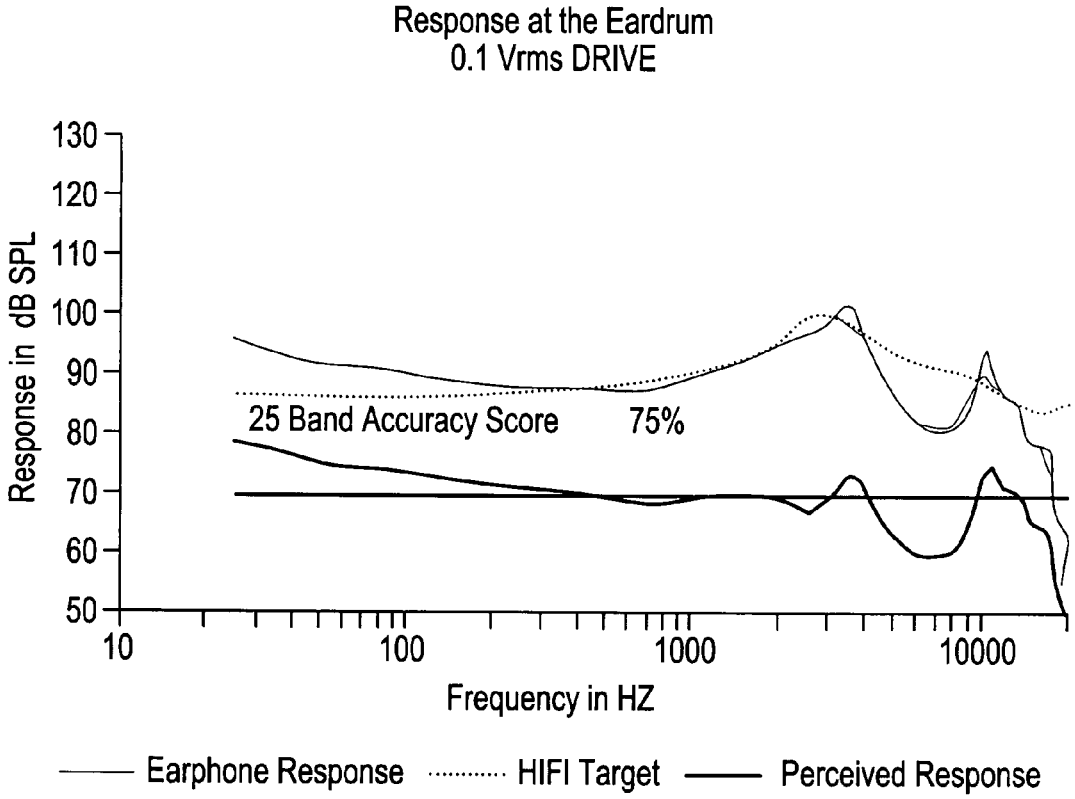
FIG. 9A is a graph illustrating acoustic bass boost, in accordance with an embodiment of the invention.

FIG. 9A is a graph illustrating acoustic bass boost, in accordance with an embodiment of the invention.

Figure 9B:
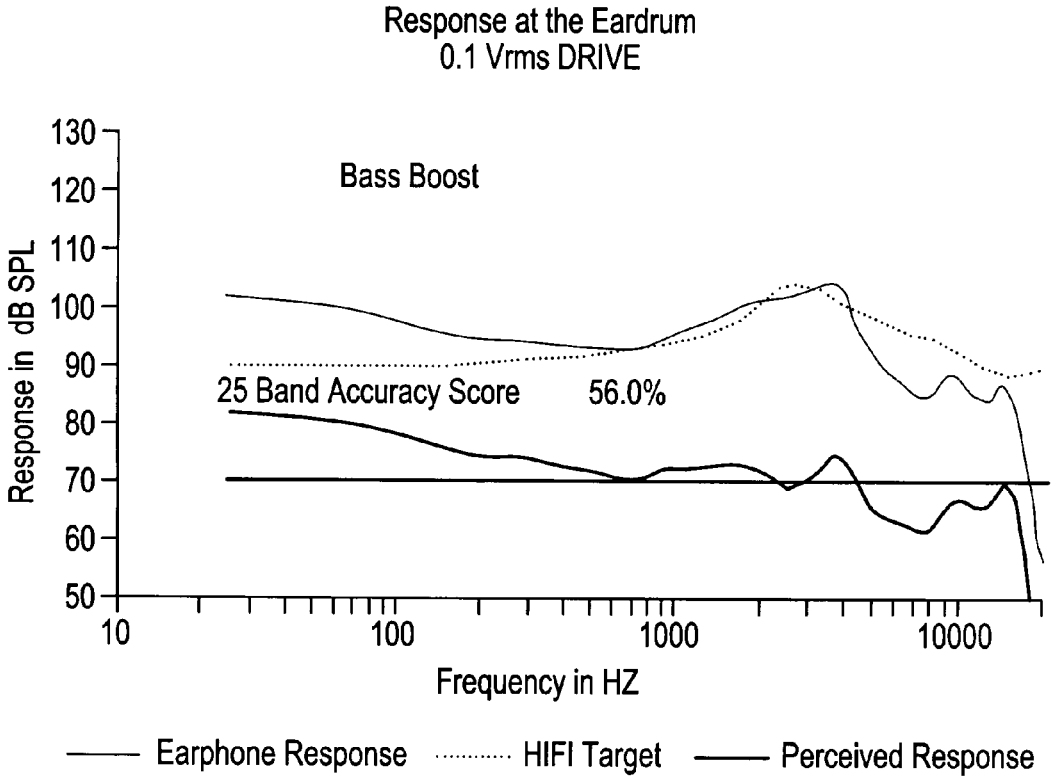
FIG. 9B is a graph illustrating bass boost, in accordance with an embodiment of the invention.

FIG. 9B is a graph illustrating bass boost, in accordance with an embodiment of the invention.

In accordance with an embodiment of the invention, small scale speakers may be tuned to have an optional sub-frequency resonance by venting the rear volume through a highly inductive and resistive vent. In this regard, the correct band of sub frequencies may be increased.

For example, a boost in a speaker may be tuned to create a mild boost (FIG. 9A) to correct a shortage of low frequencies typically occurring in a "bass adjusted system" so as to improve overall response accuracy. An additional increase in low frequency sensitivity above the reference may serve an application that requires/desires more bass response (refer to FIG. 9B). Such response adjustments may lower the accuracy score. A boost in a speaker may be tuned and a mild boost, such as illustrated in FIG. 9A, may not adversely effect the overall accuracy.

A method to tune these; small scale speakers to have an optional sub-frequency resonance can be accomplished when rear speaker auxiliary duct 536A, vents either through auxiliary damping element 538A or directly into auxiliary volume 540A, which may be blocked at auxiliary duct 542A. If a larger rear volume is required, any combination of auxiliary damping elements 538A, 544A, and/or 506A may be used in conjunction with auxiliary ducts 536A, 542A, and/or 504A that vent into either or both auxiliary volumes 540A and 508A.

In this regard, the correct band of sub frequencies may be increased. For example, a speaker may be tuned to create a mild boost to correct a shortage of low frequencies typically occurring in a "bass adjusted system". An additional increase in low frequency sensitivity may serve an application that requires/desires more bass response (refer to FIG. 9A). FIG.

9B demonstrates an extreme adjustment to the bass frequencies. The resulting sound quality may be characterized as "tubby" or undesirable.

Accordingly, aspects of the invention may be realized in hardware, software, firmware or a combination thereof. The invention may be realized in a centralized fashion in at least one computer system or in a distributed fashion where different elements are spread across several interconnected computer systems. Any kind of computer system or other apparatus adapted for carrying out the methods described herein is suited. A typical combination of hardware, software and firmware may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context may mean, for example, any expression, in any language, code or notation, of a set of instructions intended to cause a system having an information processing capability to perform a particular function either directly or after either or both of the following: a) conversion to another language, code or notation; b) reproduction in a different material form. However, other meanings of computer program within the understanding of those skilled in the art are also contemplated by the present invention.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. An insert earphone assembly, comprising:

a body;

a transducer located in said body, said transducer for converting electrical signals received into sound energy;

an insert element, said insert element at least partially integrated within said body, said insert element comprising a main sound channel for communicating said sound energy from said transducer to a user, wherein one or more of said body and said insert element comprise at least one auxiliary duct and at least one auxiliary volume space, wherein one or more of a diameter, a length and a shape of said at least one auxiliary duct or said at least one auxiliary volume space is adjustable so as to modify an insertion response characteristic of said insert earphone assembly.

2. The assembly of claim 1 wherein said at least one auxiliary duct and said at least one auxiliary volume space are separated by at least one auxiliary damper.

3. The assembly of claim 1 further comprising an eartip, wherein said eartip is received by at least a portion of said insert element.

4. The assembly of claim 1 wherein said body and said insert element are integrated into a single body.

5. The assembly of claim 1 wherein said insert element comprises a resonant duct extending from said main sound channel and one or more of a diameter, a length and a shape of said at least one resonant duct is adjustable so as to modify an insertion response characteristic of said insert earphone assembly.

6. The assembly of claim 5 wherein said at least one resonant duct is tuned to a ¼ wave anti-resonance at a desired frequency.

7. The assembly of claim 5 wherein said at least one resonant ducts comprises four interconnected volume portions.

8. The assembly of claim 7 wherein said four interconnected volume portions are connected at varying angles.

9. The assembly of claim 1 wherein the transducer is at least one of:

a balanced armature driver, and a moving coil driver.

10. The assembly of claim 1 wherein said insert element is a slender form factor to allow deep insertion in the ear for achieving at least 20 dB external noise isolation.

11. The assembly of claim 1 further comprising at least one of:

a passive electrical filter for varying a frequency response of the insert earphone, and an electrical filter/bypass circuit for modifying a bass response.

12. The assembly of claim 11 wherein said electrical filter/bypass circuit uses a modified Thuras tube.

13. An insert earphone apparatus comprising:

a main sound channel; and at least one resonant duct, wherein said at least one resonant duct extends from said main sound channel, wherein one or more of a diameter, a length and a shape of said at least one resonant duct is adjustable so as to modify an insertion response of said insert earphone apparatus.

14. The assembly of claim 13 wherein the at least one resonant duct is tuned to a ¼ wave anti-resonance at a desired frequency.

15. The assembly of claim 13 wherein the at least one resonant duct comprises four interconnected volume portions.

16. The assembly of claim 15 wherein the four interconnected volume portions are connected at varying angles.

17. The assembly of claim 13 further comprising at least one auxiliary damper and at least one auxiliary volume for achieving an anti-resonance effect.

* * * * *